United States Patent [19]

Hall

[11] 4,042,472

[45] Aug. 16, 1977

[54] ELECTROLYTIC PROCESS FOR 7-METHOXY-3-EXOMETHYLENECEPHAM COMPOUNDS

[75] Inventor: David A. Hall, Indianapolis, Ind.

[73] Assignee: Eli Lilly and Company, Indianapolis, Ind.

[21] Appl. No.: 676,183

[22] Filed: Apr. 12, 1976

[51] Int. Cl.[2] ..... C25B 3/00

[52] U.S. Cl. ..... 204/73 R; 204/59 R; 544/21

[58] Field of Search ..... 204/59 R, 72, 73 R

[56] References Cited

U.S. PATENT DOCUMENTS 3,792,995 2/1974 Ochiai et al. ..... 204/72

3,932,393 1/1976 Chauvette ..... 260/243 C

*Primary Examiner*—F.C. Edmundson

*Attorney, Agent, or Firm*—William B. Scanlon; Everet F. Smith

[57] ABSTRACT

7-Acylamino-7-methoxycephalosporins substituted in the 3-position with an acetoxymethyl, halomethyl or 3-thio-substituted-methyl substituent are reduced electrolytically to provide the corresponding 3-exomethylenecepham compound. For example, 7-(2-thienylacetamido)-7-methoxy-3-acetoxymethyl-3-cephem-4-carboxylic acid is electrolytically reduced to provide 7-(2-thienylacetamido)-7-methoxy-3-exomethylenecepham-4-carboxylic acid and a lesser amount of the corresponding 3-methylcephalosporin compound.

1 Claim, No Drawings

ELECTROLYTIC PROCESS FOR 7-METHOXY-3-EXOMETHYLENECEPHAM COMPOUNDS

BACKGROUND OF THE INVENTION

3-Exomethylenecepham compounds were first described by Morin and Jackson in U.S. Pat. No. 3,275,626 wherein their formation in the penicillin sulfoxide rearrangement is discussed. R. R. Chauvette describes in U.S. Pat. No. 3,932,393 a process for the preparation of 3-exomethylenecepham compounds from 3-thio-substituted-methylcephalosporin compounds under chemical and catalytic reduction conditions. M. Ochiai, et al. describe in U.S. Pat. No. 3,792,995 an electrolytic reduction process for the preparation of 3-exomethylenecepham compounds, and in U.S. Pat. No. 3,929,775, a reduction process employing chromous salts, both of which processes can be carried out on cephalosporanic acids. Further, Poticello et al. describe in U.S. Pat. No. 3,883,518 the reduction of 3-acetoxymethyl and 3-carbamoyloxymethyl substituted 7-methoxycephalosporin compounds with, for example, zinc dust and formic acid to prepare 7-methoxy-3-exomethylenecepham compounds.

Chauvette in U.S. Pat. No. 3,932,393 further teaches a process for the isomerization of the 3-exomethylenecepham compounds to 3-methyl-3-cephem compounds, desacetoxycephalosporanic acids, which are well known antibiotic compounds.

Co-pending application Ser. No. 278,668, now abandoned, describes a process for electrolytically reducing 3-thio-substituted methylcephalosporins and cephalosporanic acids to 3-exomethylenecepham compounds.

This invention is concerned with a reduction process for the preparation of 7-methoxy-3-exomethylenecepham compounds. In particular this invention is concerned with a process for the electrolytic reduction of 7-methoxy substituted cephalosporanic acids and 7-methoxy-3-substituted-methylcephalosporin compounds to provide 7-methoxy-3-exomethylenecepham compounds.

SUMMARY OF THE INVENTION

The electrolytic reduction process of this invention comprises the electrolysis of 7-acylamido-7-methoxycephalosporanic acids and 7-acylamido-7-methoxy-3-substituted-methyl-3-cephem-4-carboxylic acids represented by the Formula I

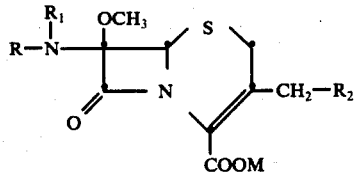

to provide the corresponding 7-methoxy-3-exomethylenecepham represented by the formula II

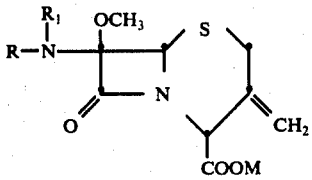

wherein R is an acyl group derived from a carboxylic acid, $R_1$ is hydrogen or R and $R_1$ together represent a cyclic diacyl group, and M is hydrogen or a cation such as sodium or potassium ion. The process is carried out at the cathode of an electrolytic cell in an aqueous medium at a pH between about 2.5 and 8.5 and preferably between pH 4 to 6 or in an organic solvent containing a proton source. The electrolysis is carried out either at constant potential or at constant current at a temperature between about 5° and 45° C and preferably at about 20°-35° C.

The 7-methoxy-3-exomethylenecepham product represented by the formula II and the co-produced 7-methoxy-3-methyl-3-cephem product are recovered from the reduction solution and are separated by chromatography.

DETAILED DESCRIPTION

The starting materials used in the process of this invention are cephalosporin compounds of the formula I

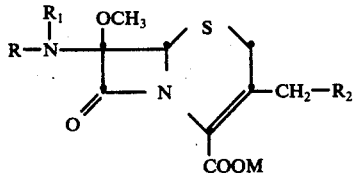

wherein R is $C_1$–$C_4$ alkanoyl, 5-amino-5-carboxyvaleryl, or benzoyl, or an aralkanoyl or aryloxyalkanoyl group of the formula

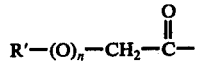

wherein R′ is phenyl, phenyl substituted by $C_1$–$C_4$ alkyl, $C_1$–$C_4$ alkoxy, halogen, amino, hydroxy; or R′ is thienyl, furyl, imidazolyl, oxazolyl, thiazolyl, triazolyl or tetrazolyl and wherein n is 0 or 1; with the limitation that when n is 1 R′ is phenyl or substituted phenyl;

or R is an α-substituted aralkanoyl group of the formula

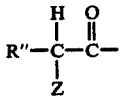

wherein R″ is phenyl, phenyl substituted by $C_1$–$C_4$ alkyl, $C_1$–$C_4$ alkoxy, halogen, amino or hydroxy, or R″ is thienyl or furyl;

Z is amino, hydroxy, formyloxy or $C_2$–$C_4$ alkanoyloxy, $R_1$ is hydrogen or $R_1$ and R taken together with the nitrogen atom to which they are attached are succinimido or phthalimido;

$R_2$ is acetoxy, halogen, pyridinium, cabamoyloxy, or a group of the formula $$-S-R_3$$

wherein $R_3$ is $C_1$–$C_4$ alkyl, $C_1$–$C_4$-alkoxythionocarbonyl, $C_1$–$C_4$-alkanoyl, benzoyl, thiocarbamoyl, amidino or a 5 or 6 membered nitrogen containing heterocyclic ring;

and M is hydrogen, as alkali metal cation, and a unit negative charge when $R_2$ is pyridinium or when $R_3$ is amidino.

In the above formula I the term "$C_1$ -$C_4$ alkanoyl" refers to formyl, acetyl, propionyl, butyryl, isobutyryl and like lower alkanoyl groups; "halogen" refers to fluoro, chloro or bromo; "$C_1$ -$C_4$ alkyl" refers to methyl, ethyl, n-propyl, iso-propyl, n-butyl, t-butyl and like lower alkyl groups; and "$C_1$-$C_4$ alkoxy" refers to methoxy, ethoxy, n-propoxy, iso-propoxy, n-butoxy, and t-butoxy.

Examples of acyl groups represented by R in formula I are those wherein R is the aralkanoyl group

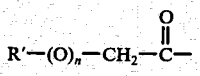

wherein $n$ is O and R′ is phenyl or substituted phenyl such as phenylacetyl 4-methoxyphenylacetyl, 3,4-dimethoxyphenylacetyl, 2,6-dimethoxyphenylacetyl, 4-methylphenylacetyl, 4-t-butylphenylacetyl, 3,4-dimethylphenylacetyl, 2 -ethylphenylacetyl, 4-iso-propylphenylacetyl, 3,4-dichlorophenylacetyl, 2,6-dichlorophenylacetyl, 4-bromophenylacetyl, 3-bromophenylacetyl, 4-fluorophenylacetyl, 3-aminophenylacetyl, 2-aminophenylacetyl, 4-aminophenylacetyl, 4-hydroxyphenylacetyl, 3-hydroxyphenylacetyl, 3,4-dihydroxyphenylacetyl, 3-chloro-4-hydroxyphenylacetyl, 3,5-dichloro-4-hydroxyphenylacetyl, 3-hydroxy-4-methylphenylacetyl, 2-hydroxy-4-methylphenylacetyl, 3-bromo-4-hydroxyphenylacetyl, 3-methoxy-4-hydroxyphenylacetyl, 3-methoxy-4-chlorophenylacetyl, 3-methyl-4-aminophenylacetyl, 3-bromo-4-methylphenylacetyl, 3,4,5-trimethylphenylacetyl, 3,4,5-trimethoxyphenylacetyl, and the like acyl groups.

Examples of aryloxyalkanoyl groups wherein n is 1 are phenoxyacetyl, 4-chlorophenoxyacetyl, 3-methylphenoxyacetyl, 3-bromophenoxyacetyl, 4-hydroxyphenoxyacetyl, 3,4-dimethoxyphenoxyacetyl, 3-chloro-4-hydroxyphenoxyacetyl, 4-aminophenoxyacetyl, 2,4-dimethylphenoxyacetyl, 2,4-diethylphenoxyacetyl, 4-hydroxy-3-ethoxyphenoxyacetyl, 3,5-dichloro-4-hydroxyphenoxyacetyl, 4-fluorophenoxyacetyl, 2-methyl-4-hydroxyphenoxyacetyl, and like acyl groups.

Examples of acyl groups of the formula I wherein R′ is a heterocyclic ring include 2-thienylacetyl, 3-thienylacetyl, 2-furylacetyl, the groups 2-oxazolylacetyl, 2-thiazolylacetyl, and 2-imidazolyl represented by the formula

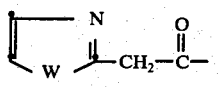

wherein W is respectively -O-, -S-, and -NH-; 2(1,3,4-triazolyl)acetyl, or tetrazolylacetyl of the formula

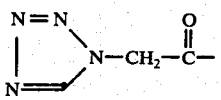

Examples of α-substituted aralkanoyl groups of the formula

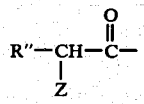

are the arylglycyl (Z = amino) groups phenylglycyl, 2-thienylglycyl, 3-thienylglycyl, and 2-furylglycyl; the α-hydroxy substituted acyl group (Z = hydroxy) such as mandeloyl (α-hydroxyphenylacetyl), α-hydroxy-2-thienylacetyl, α-hydroxy-2-furylacetyl, α-hydroxy-3-thienylacetyl and the formuloxy, acetoxy, propionoxy and butyryloxy derivatives thereof. R″ can be substituted phenyl, examples of which are illustrated above in the examples of substituted phenyl groups represented by R′.

The 3-thio-substituted-methyl compounds employed as starting materials in the present process are represented by the Formula I wherein $R_2$ is the group -S-$R_3$. Illustrative of the thio substituents, -S-$R_3$ are the alkylthio groups such as methylthio, ethylthio, n-propylthio, iso-propylthio and the like, the amidinothio group forming an isothiouronium salt as for example the group represented by the formula

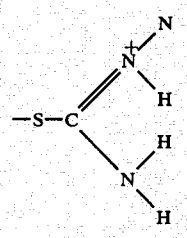

the thiocarbamoyl group represented by the formula

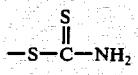

the lower alkoxythionocarbonylthio group represented by the formula

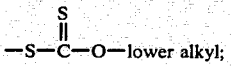

the lower alkanoylthio group represented by the formula

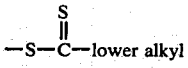

such as acetylthio; propionylthio and butyrylthio; benzoylthio; or -S-$R_3$ is a heterocyclic-thio group wherein $R_3$ is a 5 or 6 membered nitrogen containing heterocyclic ring such as 2- or 4-pyridyl, 2-pyrimidyl, imidazol-2-yl, oxazol-2-yl, thiazol-2-yl, 1-methyl-1H-tetrazol-2-yl, 1,3,4-triazol-2-yl, 1,2,3-triazol-5-yl, 5-methyl-1,3,4-thiadiazol-2yl, and 5-methyl-1,3,4-oxadiazol-2-yl.

According to the process of this invention, a compound of the Formula I as the free acid or in the form of an alkali metal salt such as the sodium of potassium salt is reduced at the cathode of an electrolytic cell to provide via a 2 electron reduction a 7-methoxy-3-exomethylenecepham acid or salt and in lesser amounts the corresponding 3-methyl-3-cephem acid or salt. The process is illustrated by the following general reaction scheme.

I

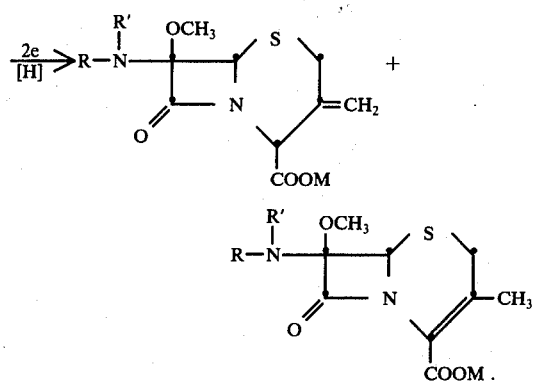

The compound of the Formula I is dissolved in an organic solvent or a aqueous solvent system and the solution is placed in contact with the cathode of an electrolytic cell. Current is then allowed to pass through the cell until an amount of current corresponding to between one and two times the number of Faradays required for a 2-electron reduction has passed. The electrolytic process of this invention is an especially convenient cathode reduction process which occurs with ease in commonly constructed electrolysis apparatus. For example, the present process can be carried out in a conventional electrolytic cell, such as those described by M. J. Allen, *Organic Electrode Processes,* Reinhold Publishing Corp. New York, 1958 page 33, comprising a suitable cathode and anode separated by a bridge. The cathode is selected from among those metals having a hydrogen over potential equal to or greater than the reduction potential of the substrate compound. Such metals include, for example, mercury, zinc, lead, tin, cadmium or copper. A preferred cathode is one of mercury. Anodic materials which can be used are any of a wide variety of conducting materials commonly employed as anodes such as platinum, iron, carbon, palladium and silver. Platinum metal is a preferred anode and particularly in the form of a fine gauze or wire mesh. Carbon is another preferred anode because of its low cost.

The bridge connecting the cathode and anode can be a conventional salt bridge, for example, 4 percent aqueous agar saturated with potassium chloride, or a suitable porous membrane such as an ion-exchange membrane, a ceramic membrane, agar gel, cellophane or a sintered glass membrane of small to medium porosity. Also those membranes described and discussed by M. J Allen supra can be employed.

As previously mentioned the substrate cephalosporin compound is reduced in an organic solvent with a porton donor or in an aqueous organic solvent. Solvents which can be used in the present process include water, mixtures of water with water miscible organic solvents such as methanol, ethanol, dimethylformamide (DMF), acetonitrile, or dimethylacetamide. When water or an aqueous solvent system is employed the solution is buffered to maintain the pH of the solution between about pH 2.5 and pH 8.5, and preferably between pH 4 and pH 6. The reduction can also be carried out in non-aqueous organic solvents, for example, in acetonitrile, ethanol or DMF, in which instance the solution need not be buffered. When a non aqueous solvent system is used and the organic solvent is aprotic, for example DMF, a proton donor such as methanol, ethanol or acetic acid is added.

The pH of the aqueous reaction solution is conveniently maintained within the desired pH range by means of buffers. One such buffer is McIlvaine buffer of 0.5 M ionic strength prepared as described by Elving, P. J., Markowitz, J. M. and Rosenthal, I., Anal, Chem., 28, 1179 (1956).

The reduction can be carried out at a temperature between about 5° and 45° C. and conveniently at about 20°-25° C. over the above described pH range.

A typical electrolytic cell in which the present process can be carried out comprises a mercury pool cathode connected via a sintered glass bridge to a platinum gauze or wire anode immersed in an electrolyte, for example, a 2N solution of potassium chloride. A power supply is connected to the cell, for example, one capable of supplying 150 volts, 10 amperes of current. The cell can be equippped with a reference cell such as the standard calomel cell as well as a stirrer.

The cephalosporin compound represented by the Formula I, in a buffered aqueous solution, is added to the cathode compartment of an electrolytic cell such as the one described above. The solution is stirred and the compartment can be deaerted with an inert gas such as argon if desired. A potential is applied to the cell until an amount of current has passed which corresponds to twice the number of Faradays required for a two electron reduction. The current can be measured by means of a coulometer. The duration of the reduction depends on variable factors such as the size of the electrolytic cell, the surface area of the cathode, the concentration of the substrate in the reduction solution, the rate of stirring and the temperature.

Following the reduction, the current flow is stopped and the reaction solution is removed from the cathode compartment. The pH of the solution is adjusted to pH 2.5 and is extracted, and the reduction product mixture containing the 7-methoxy-3-exomethylenecepham-4-carboxylic acid and the 7-methoxy-3-methyl-3-cephem-4-carboxylic acid is recovered from the extract by evaporation.

During the electrolytic reduction of a cephalosporin compound as described herein, the potential applied to the electrolytic cell need not be maintained constant. For example, in a simplified procedure, the potential applied to the cell is at least equivalent to the reduction potential of the substrate cephalosporin compound but it can also be any greater potential up to the hydrogen over potential of the cathode.

The reduction potential can be determined by means of a variable voltage regulator. For example, prior to reduction, the voltage can be scanned to determined the reduction potential. The reduction is then carried out at this determined potential or at a higher potential up to the over potential of the cathode which is employed.

According to a further manner for carrying out the electrolysis process of this invention, a constant current can be maintained until reduction has ceased. Accordingly, the present process can be carried out with either a constantly controlled potential or a constantly controlled current.

In a simplified procedure, the potential applied to the cell is increased to the over potential of the cathode and maintained until the amount of current corresponding to the amount required for a 2electron reduction has passed.

In a preferred embodiment of the present invention 7-[2'-(2-thienyl)acetamido]-7-methoxycephalosporanic acid is dissolved in a mixture of 100 ml. of ethanol and 150 ml. of pH 3.6 McIlvaine buffer and the solution is added to the cathode compartment of an electrolysis cell constructed in the following manner. A cylindrical glass cathode chamber containing a mercury pool is equipped with a reference electrode, for example the standard calomel electrode, a stirrer, a deaerating frit, and a side-arm connected to a cylindrical glass anode chamber. The side-arm connecting the cathode chamber and the anode chamber, contains the salt bridge (4 percent agar, saturated with potassium chloride) or other suitable bridge. The anode chamber is filled with the electrolyte solution (2N potassium chloride solution) in which is immersed a platinum gauze anode. A power supply capable of supplying 150 volts, 10 amperes is used. Following the addition of the aqueous buffered solution of the cephalosporin to the cathode chamber, the stirrer is started and the chamber is deaerated with a argon for approximately 10 minutes prior to electrolysis. With continued stirring the reduction potential is applied and current allowed to flow. The amount of current which is allowed to pass corresponds to between 1 and 2 times the amount required for a 2 electron reduction of the amount of cephalosporin substrate used. Throughout the electrolysis the temperature of the cathode chamber is maintained at approximately 15°–25° C.

Following the reduction, which is determined by coulometry, the mercury is drained from the cathode and the remaining aqueous solution is acidified to pH 2.5 with 1N hydrochloric acid. The acidified solution is then extracted with a suitable water immiscible organic solvent and preferably ethyl acetate. The extract is washed with water and is then dried over a suitable drying agent, such as magnesium sulfate. The dired extract is evaporated in vacuo to provide the reaction product mixture. The composition of the reaction product mixture is determined by thin layer chromatography on silica gel plates with the solvent system, acetone:acetic acid 16:1 as eluent, and by development of the plates with iodine, On a small scale the reduction product mixture can be separated by preparative thin layer chromatography by employing the same adsorbent and eluent. For large scale reduction runs, the reduction products can be purified and separated from one another by means of column chromatography over silica gel.

The predominant isomer of the reduction mixture obtained by the electrolytic process of this invention is the 7-methoxy-3-exomethylenecepham-4-carboxylic acid which commonly constitutes between about 50 and 70 percent by weight of the reduction product mixture. A lesser amount of the 7-methoxy-3-methyl-3-cephem-4-carboxylic acid isomer is usually produced.

The separation of the isomeric reduction products by column chromatography can be determined by taking advantage of the difference in absorption in the 260 mμ region of the ultraviolet spectrum of the two isomers. The minor product, the 3-methyl-3-cephem, exhibits the characteristic absorption at 260 mμ for the $\Delta^3$-cephalosporin chromophore whereas this chromophore is absent in the 3-exomethylenecepham product.

In a further aspect of this invention the recovery and isolation of the 3-exomethylene isomer is enhanced by carrying out the electrolysis at a pH between about 7.5 and 8.5 and at a potential above the reduction potential for the starting material. When the electrolysis is carried out under these conditions the co-produced 3-methyl-3-cephem isomer undergoes further reduction to a non-cephalosporin degradation product via scission of the cephem ring system. The predominant product, the 3-exomethylenecepham isomer, survives under these reduction conditions and is more readily isolated from the reduction mixture. The elimination of the co-produced 3-methyl-3-cephem isomer from the reduction product mixture thus avoids the necessity of separating the two isomers in the instance where one desires only the 7-methoxy-3-exomethylenecepham product. In carrying out the electrolysis at pH 7.5 to 8.5 to produce the 3-exomethylenecepham product can unbuffered electrolyte is used preferably 0.2N sodium sulfate. During the electrolysis the pH is maintained between about 7.5 and 8.5 with sulfuric acid.

Preferred cephalosporin starting materials in the process of the invention ar represented by the formula I, wherein R is formyl, acetyl, phenylacetyl, phenoxyacetyl, 2-thienylacetyl, phenylglycyl and $R_2$ is acetoxy, carbamoyloxy, pyridinium, or benzoxylthio; for example the compounds 7-β-formamido-7-α-methoxy-3-acetoxymethyl-3-cephem-4-carboxylic acid, 7-β-phenylacetamido-7-60 -methoxy-3-acetoxymethyl-3-cephem-4-carboxylic acid, 7-β-[2-(2-thienyl-)acetamido]-7-α-methoxy-3-acetoxymethyl-3-cephem-4-carboxylic acid, 7-β-[2(2-thienyl)acetamido]-7-α-methoxy-3-pyridinium-3-cephem-4-carboxylate, 7-β-phenoxyacetamido-7-α-methoxy-3-acetoxymethyl-3-cephem-4-carboxylic acid, 7-β-(D-phenylglycylamido)-7-α-methoxy-3-acetoxymethyl-3-cephem-4-carboxylic acid and 7-β-[2-(2-thienyl)acetamido]-7-α-methoxy-3-carbamoyloxymethyl-3-cephem-4-carboxylic acid. Especially preferred starting materials of the formula I are 7-β-phenoxyacetamido-7α-methoxy-3-acetoxymethyl-3-cephem-4-carboxylic acid, 7-β-phenylacetamido-7-α-methoxy-3-acetoxymethyl-3-cephem-4-carboxylic acid and 7-β-[2-(2-thienyl)acetamido]-7-α-methoxy-3-acetoxymethyl-3-cephem-4-carboxylic acid.

The compounds represented by formula I have been previously described and can be prepared via known synthetic procedures, for example as taught in U.S. Pat. Nos. 3,780,031, 3,780,033, 3,780,034 and 3,780,037.

The compounds of the formula I wherein $R_2$ is pyridinium are prepared by reacting in aqueous acetone or other suitable solvent a compound wherein $R_2$ is acetoxy with pyridine. The compound wherein $R_2$ is a thio-substituted group $-S-R_3$ are prepared by reacting either a 3-halomethyl-3-cephem ($R_2$ = halogen) or a 3-acetoxymethyl-3-cephem ($R_2$ = acetoxy) with the thiol $H-S-R_3$ at basic pH for example pH 7.5–9.0.

The compounds represented by the formula 1 wherein $R_3$ is the amidino group are prepared by reacting a 7-methoxy-7-acylamido-3-acetoxymethyl-3-cephem-4-carboxylic acid with thiourea. The products are thiouronium salts wherein M is a unit negative charge and $R_3$ is

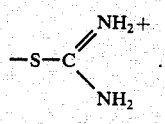

Further examples of compounds represented by the formula I are:

7-(5'-amino-5'-carboxyvaleramido)-7-methoxy-3-acetoxymethyl-3-cephem-4-carboxylic acid, 7-[2'-(2-thienyl)acetamido]-7-methoxy-3-methylthiomethyl-3-cephem-4-carboxylic acid, 7-(2'-hydroxy-2'-phenylacetamido)-7-methoxy-3-(1-methyl-1H-tetrazol-5-ylthiomethyl)-3-cephem-4-carboxylic acid, 7-[2'-(3-thienyl)acetamido]-7-methoxy-3-(5-methyl-1,3,4-thiadiazol-2-ylthiomethyl)-3-cephem-4-carboxylic acid, 7-(2'-hydroxy-2'-phenylacetamido)-7-methoxy-3-(5-methyl-1,3,4-thiadiazol-2-ylthiomethyl)-3-cephem-4-carboxylic acid, 7-propionamido-7-methoxy-3-benzoylthiomethyl-3-cephem-4-carboxylic acid, 7-2-phenylacetamido-7-methoxy-3-ethoxythionocarbonyl-thiomethyl-3-cephem-4-carboxylic acid, 7-[2'-(1H-tetrazol-5-yl)acetamido]-7-methoxy-3-acetoxymethyl-3-cephem-4-carboxylic acid, 7-[2'-(1-methyl-1H-tetrazol-5-yl)acetamido]-7-methoxy-3-ethylthiomethyl-3-cephem-4-carboxylic acid, 7-2-phenylacetamido-7-methoxy-3-amidinothiomethyl-3-cephem-4-carboxylic acid inner salt, 7-[2-(2-thienyl)acetamido]-7-methoxy-3-amidinothiomethyl-3-cephem-4-carboxylic acid inner salt, 7-[2-(4-hydroxyphenyl)acetamido]-7-methoxy-3-amidinothiomethyl-3-cephem-4-carboxylic acid inner salt, 7-[2-(4-chlorophenoxy)acetamido]-7-methoxy-3-acetylthio-3-cephem-4-carboxylic acid, 7-acetamido-7-methoxy-3-acetoxymethyl-3-cephem-4-carboxylic acid, 7-[2-(2-furyl)acetamido]-7-methoxy-3-benzoylthiomethyl-3-cephem-4-carboxylic acid, 7-2-phenoxyacetamido-7-methoxy-3-propoxythionocarbonylthiomethyl-3-cephem-4-carboxylic acid, 7-[2-(2-oxazolyl)acetamido]-7-methoxy-3-benzoylthiomethyl-3-cephem-4-carboxylic acid, 7-[2-(2-thiazolyl)acetamido]-7-methoxy-3-acetoxymethyl-3-cephem-4-carboxylic acid, 7-[2-(2-imidazolyl)acetamido]-7-methoxy-3-benzoylthiomethyl-3-cephem-4-carboxylic acid sodium salt, 7-[2-(2-triazolyl)acetamido]-7-methoxy-3-acetoxymethyl-3-cephem-4-carboxylic acid, 7-succinimido-7-methoxy-3-acetoxymethyl-3-cephem-4-carboxylic acid, and 7-phthalimido-7-methoxy-3-acetoxymethyl-3-cephem-4-carboxylic acid wherein the 7-acylamido group has the $\beta$-configuration and the 7-methoxy group the $\alpha$-configuration.

As was mentioned above the reduction of a compound of the Formula I affords a mixture of the isomeric reduction products, the 7-methoxy-3-exomethylenecepham-4-carboxylic acid and the 7-methoxy-3-methyl-3-cephem-4-carboxylic acid. The predominant product is the 3-exomethylenecepham-4-carboxylic acid. For example, the electrolytic reduction of 7-[2-(2-thienyl)acetamido]-7-methoxy-3-acetoxymethyl-3-cephem-4-carboxylic acid at pH 3.6 provides the corresponding 3-exomethylenecepham isomer and the 3-methyl-3-cephem isomer. The individual isomers of the reduction mixture can be separated from each other by column chromatography or by fractional crystallization. Chromatographic separation of the isomers is carried out over silica gel. The reduction mixture is dissolved in a small volume of chloroform and the solution is added to the top of a suitable sized column packed with silica gel. The column is then eluted with chloroform:acetonitrile (4:1) and multiple fractions of eluate are collected. Those fractions which are found to contain the individual isomers are combined. The identity of the individual isomers in the eluate fractions is determined by running thin layer chromatograms on each fraction. The pooled fractions are evaporated to yield the separated isomers.

The most abundant isomer is the reduction mixture, the 3-exomethylene isomer, thus separated from the 3-methyl-3-cephem isomer, is then isomerized to the 3-methyl-3-cephem isomer possessing antibiotic activity. The isomerization, as illustrated by the following simplified reaction scheme, involves the shifting of the exo double bond to the endo position, resulting in the formation of the $\Delta^3$-cephem compound from the 3-methylenecepham compound.

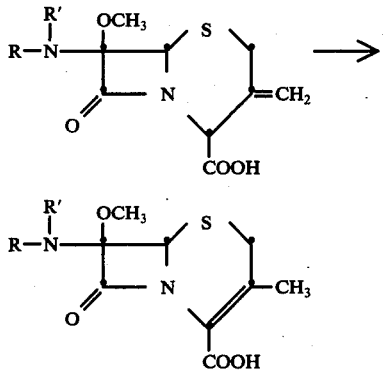

wherein R and R' have the same meanings as previously defined.

The isomerization is carried out by commingling the 3-methylenecepham acid with an aprotic solvent having a high dielectric constant and a strongly basic tertiary organic amine. Aprotic solvents which can be employed in the isomerization process are those having a high dielectric constant as for example solvents such as dimethylsulfoxide, dimethylacetamide, dimethylformamide and the like. The preferred solvent is dimethylacetamide (DMA).

Tertiary organic amines which can be used in the isomerization process in combination with an aprotic solvent include amines having a pK'a of about pK'a 9.5 or greater such as the tertiary alkyl amines containing $C_1$–$C_{10}$ alkyl groups. Illustrative of such amines are trimethylamine, triethylamine, tri-n-propylamine, methyldiethylamine, tri-n-butylamine, tri-n-octylamine, tri-n-decylamine and the like. A preferred amine is triethylamine. The amine is preferably employed in excess of the amount of 3-methylenecepham compound although lesser amounts of amine produce substantial isomerization. In many instances the isomerization proceeds satisfactorily when a few drops or a catalytic amount of the amine is employed.

The isomerization process is conveniently carried out at a temperature between about 20° and 35° C. at which temperature the isomerization is generally complete in about 8 to 12 hours.

Illustrative of the 3-exomethylenecepham-4-carboxylic acids which are provided by this invention are the following compounds.

3-methylene-7-methoxy-7-acetamidocepham-4-carboxylic acid, 3-methylene-7-methoxy-7-phenylacetamidocepham-4-carboxylic acid, 3-methylene-7-methoxy-7-phenoxyacetamidocepham-4-carboxylic acid, 3-methylene-7-methoxy-7-[2-(2-thienyl)acetamido]-cepham-4-carboxylic acid, 3-methylene-7-methoxy-7-[2-(3-thienyl)acetamido]-cepham-4-carboxylic acid, 3-methylene-7-methoxy-7-[2-(3-hydroxyphenyl)-2'-aminoacetamido]-cepham-4-carboxylic acid, 3-methylene-7-methoxy-7-[2-(2-furyl)acetamido]-cepham-4-carboxylic acid, 3-methylene-7-methoxy-7-[2-(3-thienl)-2-aminoacetamido]cepham-4-carboxylic acid, 3-methylene-7-methoxy-7-(2-phenyl-2-aminoacetamido)-cepham-4-carboxylic acid, 3-methylene-7-methoxy-7-(2-phenyl-2-hydroxyacetamido)-cepham-4-carboxylic acid, 3-methylene-7-methoxy-7-[2-(4-methylphenyl)acetamido]-cepham-4-carboxylic acid, 3-methylene-7-methoxy-7-(5'-amino-5'-carboxyvaleramido)-cepham-4-carboxylic acid, 3-methylene-7-methoxy-7-propionamidocepham-4-carboxylic acid, 3-methylene-7-methoxy-7-n-butyramidocepham-4-carboxylic acid, 3-methylene-7-methoxy-7-[2-(4-methoxyphenyl)acetamido]-cepham-4-carboxylic acid, 3-methylene-7-methoxy-7-[2-(4-chlorophenyl-)acetamido]-cepham-4-carboxylic acid, 3-methylene-7-methoxy-7-[2-(1-imidazolyl-)acetamido]-cepham-4-carboxylic acid, 3-methylene-7-methoxy-7-[2-(5-methyl-1H-tetrazol-5-yl)acetamido]-cepham-4-carboxylic acid, and 3-methylene-7-methoxy-7-[2-(1H-tetrazol-5yl-)acetamido]-cepham-4-carboxylic acid.

It will be readily appreciated from the description of the present process that a wide variety of 7-methoxycephalosporanic acids and 3-substituted-methyl derivatives thereof other than those specifically mentioned can be reduced to provide the 7-methoxy-3-exomethylenecepham and 7-methoxy-3-methyl-3-cephem products. Likewise it will be appreciated that cephalosporanic acids bearing a reducible group in the 7-acylimido side chain can be employed in the present process with such rducible groups undergoing concurrent reduction. For example, any functional group having a lower reduction potential than that required for the reduction of the acetoxymethyl group or the substituted-methyl group in the 3-position of the molecule will undergo reduction. Such functional groups include the nitro, carbonyl, activated vinyl and like groups.

The following examples are provided for the purpose of further illustrating the present invention.

EXAMPLE 1

7-β-[2-(2-Thienyl)acetamido]-7-α-methoxy-3-exomethylene-cepham-4-carboxylic acid.

The title compound was prepared in a electrolysis apparatus comprising a cathode compartment connected to an anode compartment via a medium porosity sintered glass frit separator and a salt bridge consisting of a 4percent agar gel of saturated potassium chloride. The cathode compartment contained a mercury pool cathode and was equipped with a stirrer, deaerating frit and a standard Calomel reference electrode. The anode was platinum wire. The electrolyte was 0.6M McIlvaine buffer.

To the cathode compartment was added a solution of 500 g. of sodium 7-β-[2-(2-thienyl)acetamido]-7-αmethoxy-3-acetoxymethyl-3-cephem-4-carboxylate in 80 ml. of water. The electrolysis was carried out at −1.7 v., 200 ma. while the pH was maintained at 6.0 with 2N sulfuric acid by means of an automatic titration (pH stat). The electrolysis was continued for about 3hours and thereafter the solution was withdrawn from the cathode compartment. The pH of the solution was adjusted to 2.5 with concentrated sulfuric acid and was extracted with 100 ml. portions of ethyl acetate. The extract was washed with 50 ml. of 0.1N hydrochloric acid and dried over anhydrous magnesium sulfate. The dried solution was evaporated to dryness to yield the reduction product mixture. A thin layer chromatogram of the mixture run on silica gel plates with a 10 percent solution of acetic acid in acetic anhydride showed the 3-exomethylene-cepham-4-carboxylic acid to be the major component with two minor products.

The electrolysis was repeated on a larger scale (2.2 g.) in a 600 ml. jacketed electrolysis cell having a mercury pool cathode, a platinum gauze anode. The catholyte was the solution of 2.2 g. of the 7-methoxycephalosporanic acid in 210 ml. of water containing 40 ml. of ethyl alcohol and 100 ml. of 0.25M McIlvaine buffer at pH 6.0. The anolyte was 5N sodium hydroxide. The temperature of the cell was maintained at about 11° C. by circulating cold water through the cell jacket.

The product obtained was recovered as described above and was combined with the product obtained from the small scale run.

The combined products were purified as the diphenylmethyl ester on preparative silica gel thin layer plates using benzene:ethyl acetate as eluent. The nuclear magnetic resonance spectrum (T-60), 100 MHz) of the purified ester showed the following significant signals: $C_7$ methoxy at 3.4, $C_4$ hydrogen at 5.2 and $C_3 = CH_2$ at 5.25 delta.

EXAMPLE 2

7-β-Phenoxyacetamido-7-α -methoxy-3-exomethylenecepham-4-carboxylic acid.

A solution of 3.1 g. of sodium 7-phenoxyacetamido-7-methoxycephalosporanate in 100 ml. of 0.2M sodium sulfate was placed in a 600 ml. jacketed beaker containing a mercury pool cathode. Two platinum foil strips in a fine porosity frit were used as the anode and the anolyte was 5N sodium hydroxide. The electrolysis was carried out at a temperature between about 22° C. and about 25° C. The reduction product was recovered from the cathclyte by following the extraction and washing procedures described in Example 1. The reduction product mixture was isolated as 2.11 g. of a fluffy white powder.

The reduction product mixture was reacted in tetrahydrofuran with diphenyldiazomethane to convert the 3-exomethylenecepham-4-carboxylic acid to the diphenylmethyl ester. The esterified product was purified by preparative thin layer chromatography over silica gel with benzene:ethyl acetate (7:3, v:v).

The co-produced diphenylmethyl 7-phenoxyacetamido-7-methoxydesacetoxycephalosporanate was also separated from the 3-exomethylenecepham ester on the chromatogram.

EXAMPLE 3

7β-Formamido-7-α-methoxy-3-exomethylenecepham-4-carboxylic acid.

7β-Formamido-7-α-methoxycephalosporanic acid was reduced at the mercury pool cathode to provide a mixture of 7-β-formamido-7-α-methoxy-3-exomethylenecepham-4-carboxylic acid and 7-β-formamido-7-α-methoxydesacetoxycephalosporanic acid, the former of which was the major component of the mixture.

The mixture was esterified with diphenyldiazomethane and the mixture of diphenylmethyl esters separated on silica gel coated preparative thin layer plates.

The ultraviolet absorption spectrum of the separated 7-methoxy-3-exomethylenecepham ester showed no absorption in the 260 mμ region.

EXAMPLE 4

By following the electrolysis procedures described by Example 2, 7β-phenylacetamido-7-α-methoxy-3-benzoylthiomethyl-3-cephem-4-carboxylic acid is reduced and the corresponding 3-exomethylenecepham-4 carboxylic acid is isolated.

EXAMPLE 5

By following the procedures described by Example 1 7-β-(5-amino-5-carboxyvaleramido)-7-α-methoxy-3-acetoxymethyl-3-cephem-4-carboxylic acid disodium salt is reduced at the mercury cathode and the corresponding 7-α-methoxy-3-exomethylenecepham-4-carboxylic acid disodium salt is isolated.

EXAMPLE 6

7-β-[2-(2-Thienyl)acetamido]-7-α-methoxy-3-amidinothiomethyl-4-carboxylate inner salt is reduced in aqueous ethanol at the zinc cathode and the corresponding 7-α-methoxy-3-exomethylenecepham-4-carboxylic acid is recovered from the reduction product mixture.

EXAMPLE 7

7-β-Acetamido-7α-methoxy-3-bromomethyl-3-cephem-4-carboxylic acid is reduced at the mercury pool cathode and 7-β-acetamido-7-α-methoxy-3-exomethylenecepham-4-carboxylic acid is recovered from the reduction product mixture.

EXAMPLE 8

7-β-phenylacetamido-7α-methoxy-3-(1-methyl-1H-tetrazole-5-ylthiomethyl)-3-cephem-4-carboxylic acid is reduced at the mercury pool cathode and the corresponding 7-methoxy-3-exomethylenecepham-4-carboxylic acid is isolated.

I claim:

1. In the process for preparing a 7-α-methoxy-3-exomethylenecepham compound of the formula

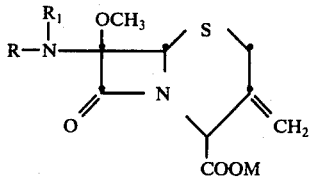

which comprises the electrolysis at a temperature between 5° and 45° C. of an aqueous solution of a 7-α-methoxy-substituted-cephalosporin compound of the formula

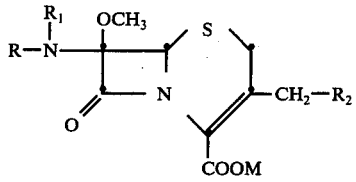

wherein said electrolysis is carried out at a cathode selected from the group consisting of mercury and zinc, and wherein R is $C_1$–$C_4$ alkanoyl, 5-amino-5-carboxyvaleryl, or benzoyl, or an aralkanoyl or aryloxyalkanoyl group of the formula

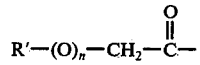

wherein R′ is phenyl, phenyl substituted by $C_1$–$C_4$ alkyl, $C_1$–$C_4$ alkoxy, halogen, amino, hydroxy; or R′ is thienyl, furyl, imidazolyl, oxazolyl, thiazolyl, triazolyl, or tetrazolyl;

and wherein $n$ is 0 or 1; with the limitation that when $n$ is 1, R′ is phenyl or substituted phenyl;

or R is an α-substituted aralkanoyl group of the formula

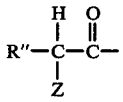

wherein R″ is phenyl, phenyl substituted by $C_1$–$C_4$ alkyl, $C_1$–$C_4$ alkoxy, halogen, amino, or hydroxy, or R″ is thienyl or furyl;

Z is amino, hydroxy, formyloxy, or $C_2$–$C_4$ alkanoyloxy, $R_1$ is hydrogen or $R_1$ and R taken together with the nitrogen atom to which they are attached are succinimido or phthalimido;

$R_2$ is acetoxy, halogen, pyridinium, carbamoyloxy, or a group of the formula $-S-R_3$ wherein $R_3$ is $C_1$–$C_4$ alkyl, $C_1$–$C_4$ alkoxythionocarbonyl, $C_1$–$C_4$ alkanoyl, benzoyl, thiocarbamoyl, amidino or a 5- or 6-membered nitrogen containing heterocyclic ring;

and M is hydrogen, an alkali metal cation, and a unit negative charge when $R_2$ is pyridinium or when $R_3$ is amidino;

the improvement which comprises carrying out the electrolysis at a pH of about 7.5 to about 8.5 at a potential above the reduction potential of said cephalosporin compound.

* * * * *